US008117719B1

(12) United States Patent
O'Brien

(10) Patent No.: US 8,117,719 B1
(45) Date of Patent: Feb. 21, 2012

(54) SYSTEM AND METHOD FOR INTERCONNECTING PIECES OF CARDSTOCK

(76) Inventor: Edward R. O'Brien, Wayne, PA (US)

( * ) Notice: Subject to any disclaimer, the term of this patent is extended or adjusted under 35 U.S.C. 154(b) by 651 days.

(21) Appl. No.: 12/244,273

(22) Filed: Oct. 2, 2008

(51) Int. Cl.

| | |
|---|---|
| ***B42F 1/00*** | (2006.01) |
| ***B42F 1/02*** | (2006.01) |
| ***B42F 1/04*** | (2006.01) |
| ***G09F 1/10*** | (2006.01) |
| ***G09F 3/08*** | (2006.01) |

(52) U.S. Cl. ..... 24/67.9; 24/3.12; 24/545; 24/546; 40/658; 40/745

(58) Field of Classification Search ..... 24/3.12, 24/3.6, 67.9, 336, 370, 545, 546, 910, 563, 24/326; 40/659, 658, 748, 764, 666, 649, 40/745, 560, 465, 1.5

See application file for complete search history.

(56) References Cited

U.S. PATENT DOCUMENTS

| | | | | | |
|---|---|---|---|---|---|
| 560,465 | A * | 5/1896 | Bostwick | 248/453 |
| 1,531,229 | A * | 3/1925 | Bernstein | 40/658 |
| 1,730,959 | A * | 10/1929 | Warfield | 40/658 |
| 2,972,826 | A * | 2/1961 | Newell | 40/1.5 |
| 3,747,263 | A | 7/1973 | Grossberg | |
| 4,449,310 | A * | 5/1984 | Kline | 40/658 |
| 4,962,603 | A * | 10/1990 | Kao et al. | 40/641 |
| 5,048,208 | A * | 9/1991 | Tatz | 40/312 |
| 5,175,913 | A | 1/1993 | Mackie et al. | |
| 5,340,071 | A * | 8/1994 | Fox, II | 248/231.81 |
| 6,470,613 | B1 * | 10/2002 | Wildrick | 40/661.03 |
| 6,860,051 | B2 * | 3/2005 | Knauf | 40/649 |
| 7,047,601 | B1 * | 5/2006 | Vernon-Woods | 24/3.12 |
| 7,121,030 | B2 * | 10/2006 | Schneider | 40/661 |
| 2002/0157745 | A1 * | 10/2002 | Stodghill | 150/137 |
| 2003/0126722 | A1 * | 7/2003 | Thompson | 24/3.12 |
| 2004/0045245 | A1 * | 3/2004 | O'Brien | 52/514 |
| 2008/0016740 | A1 * | 1/2008 | Mitten et al. | 40/649 |
| 2010/0192436 | A1 * | 8/2010 | Nunez et al. | 40/638 |

* cited by examiner

*Primary Examiner* — Robert J Sandy
*Assistant Examiner* — Louis Mercado
(74) *Attorney, Agent, or Firm* — LaHorte & Associates P.C.

(57) ABSTRACT

A system for engaging and supporting a flat piece of cardstock. The system utilizes a clip. The clip is made from a continuous strip of material. The clip is configured into four sections that are delineated by three bends. A first clip structure is defined by a first section, a first bend and a second section. The first clip structure is capable of receiving and retaining a portion of a flat piece of cardstock. Likewise, a second clip structure is defined by a second section, a second bend and a third section. The second clip structure is capable of receiving and retaining a portion of a different piece of cardstock. The clip can be supported or interconnected to other clips by a detachable tubular element, such as a straw.

14 Claims, 4 Drawing Sheets

SYSTEM AND METHOD FOR INTERCONNECTING PIECES OF CARDSTOCK

BACKGROUND OF THE INVENTION

1. Field of the Invention

In general, the present invention relates to clips that are used to engage products, such as business cards and playing cards, that are made of card stock. More particularly, the present invention relates to clips that are specifically used to interconnect multiple pieces of cardstock to one another.

2. Prior Art Description

In the prior art, cardstock is used in the manufacture of many different printed products. Examples of such products include business cards, playing cards, and greeting cards.

For most every product that is made of cardstock, there exist auxiliary devices for holding such products. For example, there are many cardholders for holding business cards. There are also many types of paper clips and other specialized clips that are specifically designed to attach a business card to another object. Likewise, there are many card holding devices for holding playing cards and greeting cards.

In U.S. Pat. No. 3,747,263 to Endres, entitled Card House Toy, a clip system is shown that is used to interconnect playing cards or other similar cardstock items. In this manner, playing cards can be built up into houses and other structures without fear of collapse. A similar system is shown in U.S. Pat. No. 5,175,913 to Mackie, entitled Connector For Use In Connecting Planar Objects. One of the problems with such prior art clips is that they are large and bulky. As such, the clips are very noticeable when a structure is constructed out of cards and the clips. Furthermore, such prior art clips are relatively expensive to make, requiring complex injection molds. A large card structure may require hundreds or thousands of such clips. Accordingly, any type of expensive clip is undesirable.

Another disadvantage of prior art card connecting clips is that they only enable cards to interconnect edge to edge. As such, prior art card clips are good for producing square card structures or rectangular card structures. However, more complex shapes cannot be obtained.

The present invention is a card connecting system that is very inexpensive to manufacture. The system utilizes clips that are very lightweight and visually inconspicuous. Furthermore, the card connecting system enables cardstock to interconnect in complex shapes and formations. As a result, the present invention is believed to be an improvement in the art, as is described and claimed below.

SUMMARY OF THE INVENTION

The present invention is a system for engaging and supporting a flat piece of cardstock. The system utilizes a clip. The clip is made from a continuous strip of material having a first end and a second end. The clip is configured into four sections that are delineated by three bends. A first section extends from a first end of the clip to a first bend in a first direction. A second section extends from the first bend to a second bend in an opposite second direction. A third section extends from the second bend to a third bend in the first direction. Finally, a fourth section extends from the third bend to the second end in a direction generally perpendicular to the stated first direction.

A first clip structure is defined by the first section, the first bend and the second section. The first clip structure is capable of receiving and retaining a portion of a flat piece of cardstock.

Likewise, a second clip structure is defined by the second section, the second bend and the third section. The second clip structure is capable of receiving and retaining a portion of a different piece of cardstock.

The clip can be supported or interconnected to other clips by a detachable tubular element, such as a straw.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention system can be used to engage many types of printed card stock, such as greeting cards and photographs, the present invention is particularly well suited to engage business cards and playing cards. Accordingly two exemplary embodiments of the present invention have been selected for illustration. The first embodiment shows the present invention engaging a business card. The second embodiment shows the present invention engaging playing cards. Both embodiments are merely exemplary and should not be considered limitations when interpreting the scope of the claims.

Figure 1:
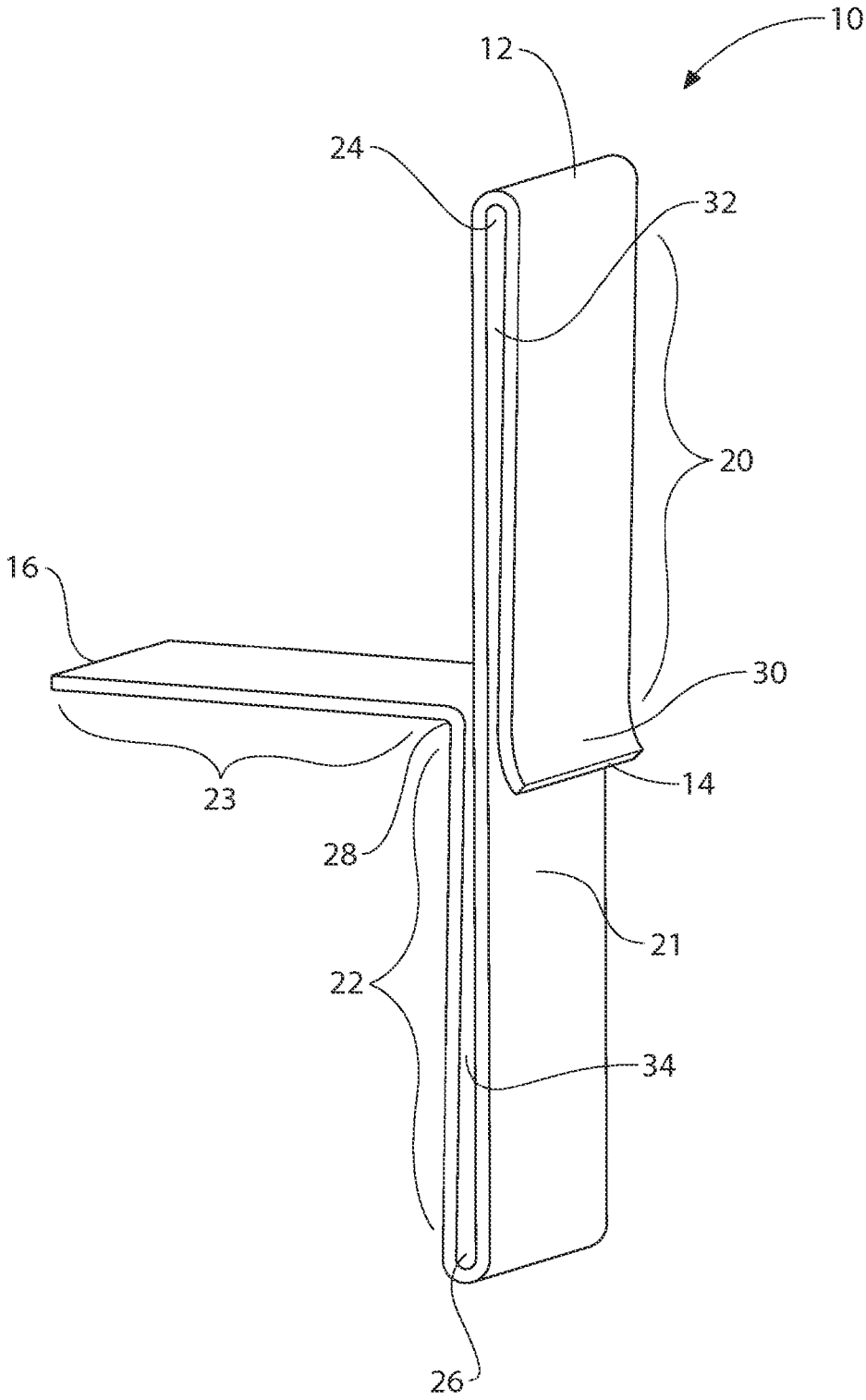
FIG. 1 is a perspective view of an exemplary embodiment of a clip utilizing by the present invention system.

Referring to FIG. 1 a clip 10 is shown. The clip 10 is made from a narrow strip 12 of flexible metal that has been folded in a serpentine pattern. The strip 12 of flexible metal has a first end 14 and a second end 16. The serpentine pattern folds the flexible metal strip 12 into four distinct straight sections 20, 21, 22, 23 between the first end 14 and the second end 16. The four straight sections 20, 21, 22, 23 are delineated by three bends, which include two 180-degree bends 24, 26 and one 90-degree bend 28.

The first straight section 20 of the clip 10 extends between the first end 14 and the first 180-degree bend 24. A slight flare bend 30 may be present proximate the first end 14 to facilitate the engagement of the clip 10 with a piece of cardstock. The second straight section 21 of the clip 10 extends from the first 180-degree bend 24 to the second 180-degree bend 26. The third straight section 22 of the clip 10 extends from the second 180-degree bend 26 to the 90-degree bend 28. Finally, the fourth straight section 23 of the clip 10 extends from the 90-degree bend 28 to the second end 16 of the metal strip 12.

The first, second and third straight sections 20, 21, 22 of the clip 10 are generally parallel. The fourth section 23 of the clip 10 extends away from the third section 22 at generally a right angle.

A first clip structure 32 is disposed between the first straight section 20 and the second straight section 21. The first clip structure 32 is capable of receiving and engaging the edge of a piece of cardstock, as will later be explained.

Likewise, a second clip structure 34 is disposed between the second straight section 21 and the third straight section 22. The second clip structure 34 is capable of receiving and engaging the edge of a piece of cardstock, as will later be explained.

Figure 2:
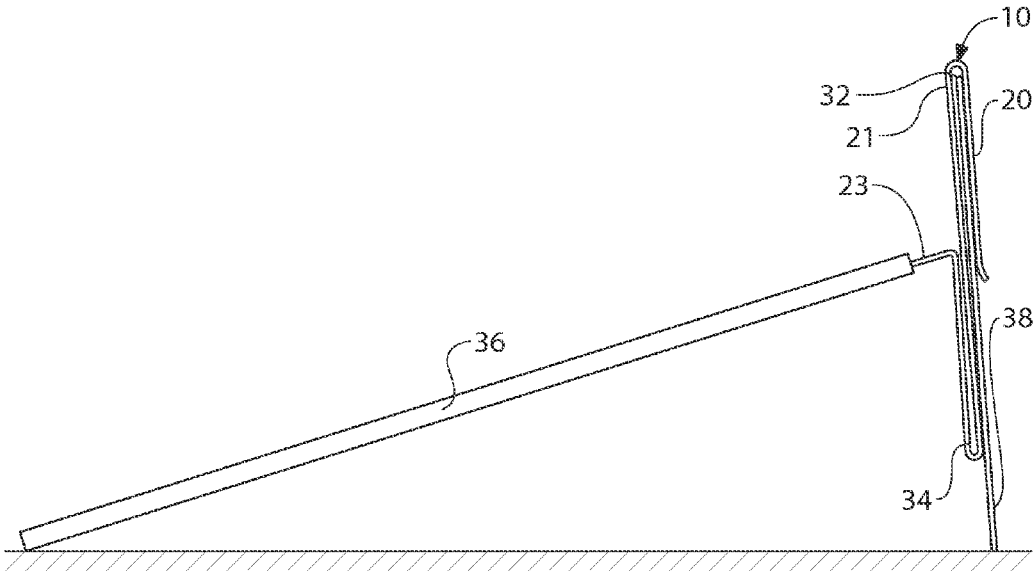
FIG. 2 is a perspective view of an exemplary embodiment of the system being used to support a business card.

Referring to FIG. 2 in conjunction with FIG. 1, it can be seen that the strip 12 of metal used in the creation of a clip 10 has a width that is slightly wider than the diameter of a straw 36. In this manner, the fourth straight section 23 of the clip 10 can pass into the open end of a straw 36 and engage the inside of the straw 36 with an interference fit.

A business card 38 is placed into the first clip structure 32 between the first straight section 20 and the second straight section 21 of the clip 10. The clip 10 and straw 36 combine to create a stand for the business card 38 that holds the business card 38 in an upright, freestanding position. It will be understood that greeting cards, photographs and any other printed piece of cardstock can be held upright in the same manner. Likewise, it will be understood that the business card 38 can be placed in the second clip structure 34 instead of the first clip structure 32, wherein the business card 38 would still be displayed in the same manner.

Figure 3:
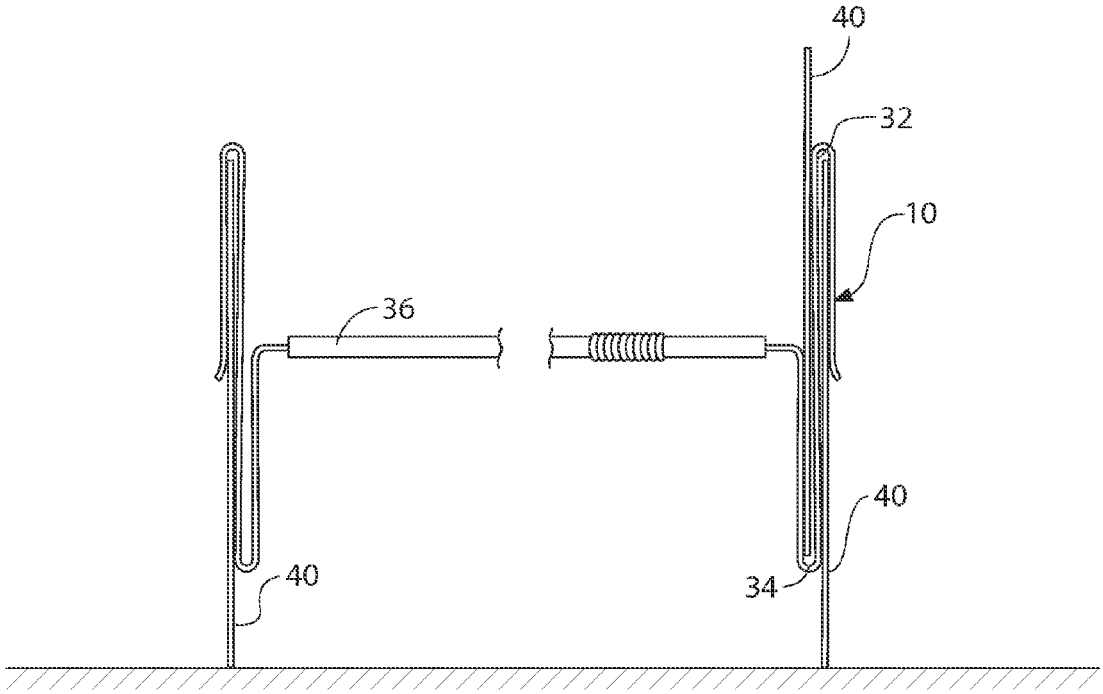
FIG. 3 is a perspective view of an exemplary embodiment of the system being used to support multiple playing cards.

Referring to FIG. 3 in conjunction with FIG. 1, an assembly is shown wherein a plurality of playing cards 40 are connected together using clips 10 and straws 36. By placing the edges of separate cards 40 into both the first clip structure 32 and the second clip structure 34 of the same clip 10, the two cards 40 can be held edge to edge in the same plane. Furthermore, by connecting straws 36 between clips 10, separate parallel walls of cards can be created without sidewalls. Furthermore, if a straw 36 is used that has a corrugated bending section, straws 36 can be used to support card walls at selected angles.

The ability to interconnect cards 40 with clips enables large card walls to be constructed. Furthermore, the ability to interconnect clips 10 with straws 36 enables different card walls to be interconnected at many angles. Consequently, large complex structures can be created from cards 40 and other printed cardstock items.

The clips 10 are made from small folded strips of metal and can be made very inexpensively with simple manufacturing tooling. Likewise, straws 36 are widely commercially available and are very inexpensive. By combining the clips 10 with straws 36, a simple construction system is created for cards 40 or any other cardstock item. The construction system can be used for fun by children or can be used to create complex trade show displays and point-of-sale displays.

Although the present invention system illustrates clips 10 that engage cards and interconnect with drinking straws 36, it should be understood that the scale of the system can be dramatically increased or decreased. Large clips can be used with pieces of PVC piping or similar conduit to support large posters or display boards. Likewise small clips can be manufactured that interconnect with small stirring straws for interconnecting small printed objects or to hold business cards in a less obtrusive manner.

Figure 4:
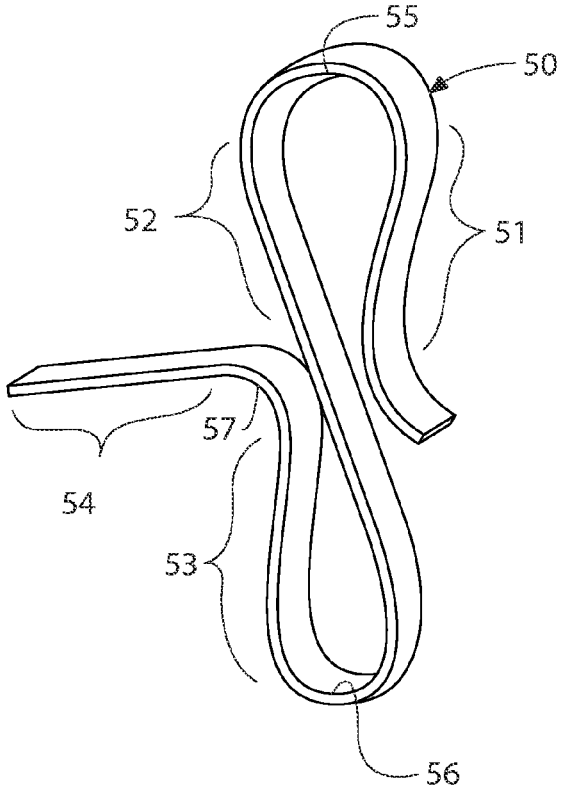
FIG. 4 is a perspective view of an alternate embodiment of a clip.

Referring now to FIG. 4, an alternate embodiment of a clip 50 is shown. The clip 50 is molded from plastic, rather than bent from metal. The clip 50 has four sections 51, 52, 53, 54 divided by three bends 55, 56, 57. However, to alleviate the stresses in the plastic, the sections 51, 52, 53 between the bends 55, 56, 57 are slightly curved. Furthermore, the bends 55, 56, 57 have a larger radius of curvature than would be necessary with a metal clip.

It will further be understood that the embodiments of the present invention that are illustrated and described are merely exemplary. A person skilled in the art can make many variations to the illustrated embodiments. For instance, the width, length, and gauge of the clip can be varied as a matter of design choice. All such variations, modifications, and alternate embodiments are intended to be included within the scope of the present invention as defined by the claims.

What is claimed is:

1. A system for engaging and supporting a flat piece of cardstock, said system comprising:

a continuous strip of material having a first end and a second end, said strip of material being configured into four sections that are delineated by three bends, wherein a first section extends from said first end to a first 180 degree bend in a first direction, a second section extends from said first 180 degree bend to a second 180 degree bend in an opposite second direction, a third section extends from said second 180 degree bend to a 90 degree bend in said first direction, and a fourth section extends from said 90 degree bend to said second end in a direction generally perpendicular to said first direction;

wherein a first clip structure capable of receiving and retaining a portion of a flat piece of cardstock is defined by said first section, said first 180 degree bend and said second section;

wherein a second clip structure capable of receiving and retaining a portion of a flat piece of cardstock is defined by said second section, said second 180 degree bend and said third section; and a straw having an open first end, wherein are least part of said fourth section of said continuous strip of material extends into said open end of said straw, therein mechanically interconnecting said straw to said continuous strip of material.

2. The system according to claim 1, wherein said first clip structure and said second clip structure face in opposite directions.

3. The system according to claim 1, wherein said continuous strip of material is metal.

4. The system according to claim 1, wherein said first section, said second section and said third section are generally parallel.

5. The system according to claim 1, wherein said first section, said second section, said third section and said fourth section are all generally straight sections.

6. A system for holding at least one card, said system comprising:

a continuous strip of material having a first end and a second end, said strip of material being configured into four sections that are delineated by three bends, wherein a first section extends from said first end to a first bend, a second section extends from said first bend to a second bend, a third section extends from said second bend to a third bend, and a fourth section extends from said third bend to said second end;

wherein a first clip structure is defined by said first section, said first bend and said second section;

wherein a second clip structure is defined by said second section, said second bend and said third section;

a straw having an open first end, wherein are least part of said fourth section of said continuous strip of material extends into said open end of said straw, therein mechanically interconnecting said straw to said continuous strip of material.

7. The system according to claim 6, wherein said first clip structure and said second clip structure face in opposite directions.

8. The system according to claim 6, wherein said continuous strip of material is metal.

9. The system according to claim 6, wherein said first section, said second section and said third section are generally parallel.

10. The system according to claim 6, wherein said first bend and said second bend are 180 degree bends.

11. The system according to claim 6, wherein said first section, said second section, said third section and said fourth section are all generally straight sections.

12. A method of supporting at least one card, comprising the steps of:

providing a continuous strip of material having a first end and a second end, said strip of material being configured into four sections that are delineated by three bends, wherein a first section extends from said first end to a first bend, a second section extends from said first bend to a second bend, a third section extends from said second bend to a third bend, and a fourth section extends from said third bend to said second end, wherein a first clip structure is defined by said first section, said first bend and said second section, and wherein a second clip structure is defined by said second section, said second bend and said third section;

inserting a card into said first clip structure;

providing a tubular support having and open end; and inserting at least part of said fourth section into an open end of said tubular support, therein interconnecting said tubular support to said fourth section.

13. The method according to claim 12, further including the step of inserting a second card into said second clip structure.

14. The method according to claim 12, wherein said tubular support is a drinking straw.

* * * * *